US008579015B2

(12) United States Patent
Stark

(10) Patent No.: US 8,579,015 B2
(45) Date of Patent: Nov. 12, 2013

(54) INSERTABLE DUAL-PASS COOLING COILS

(76) Inventor: Walter Stark, Huntington, NY (US)

( * ) Notice: Subject to any disclaimer, the term of this patent is extended or adjusted under 35 U.S.C. 154(b) by 0 days.

(21) Appl. No.: 13/590,169

(22) Filed: Aug. 20, 2012

(65) Prior Publication Data

US 2013/0098580 A1 Apr. 25, 2013

Related U.S. Application Data

(63) Continuation-in-part of application No. 13/317,660, filed on Oct. 25, 2011.

(51) Int. Cl.
*F28F 7/00* (2006.01)
*F28F 9/00* (2006.01)

(52) U.S. Cl.
USPC ..... 165/76; 165/162

(58) Field of Classification Search
USPC ..... 165/9, 75, 76, 78, 158, 162
See application file for complete search history.

(56) References Cited

U.S. PATENT DOCUMENTS

| | | | | | |
|---|---|---|---|---|---|
| 1,787,444 | A | * | 1/1931 | French | 165/72 |
| 1,841,361 | A | * | 1/1932 | Bulkeley | 165/74 |
| 2,582,134 | A | * | 1/1952 | Kimmell et al. | 122/33 |
| 3,212,288 | A | * | 10/1965 | Herbert | 62/290 |
| 3,738,305 | A | * | 6/1973 | Campbell et al. | 114/73 |
| 3,858,291 | A | * | 1/1975 | Perpall | 29/890.03 |
| 5,035,281 | A | * | 7/1991 | Neuenfeldt et al. | 165/76 |
| 5,054,545 | A | * | 10/1991 | Ghaemian | 165/104.33 |

* cited by examiner

*Primary Examiner* — Tho V Duong
(74) *Attorney, Agent, or Firm* — Alfred M. Walker

(57) ABSTRACT

An insertable, removable cooling coil in a heat exchange unit includes a heat exchange housing and one or more cooling coils in a heat exchange assembly in the housing. The housing is a pre-assembled housing having one or more respective recesses for insertion or removal of each respective cooling coil of the one or more cooling coils therein. Each cooling coil is slidably insertable upon side angle profile supports within the respective recesses of the heat exchange housing.

7 Claims, 8 Drawing Sheets

Vertical Coils with Sloped Drain Pan

Sloped Drain Pan Under Horizontally Positioned Dual-Pass Cooling Coil

Multiple Sloped Drain Pans Under Horizontally Positioned Dual-Pass Cooling Coil

INSERTABLE DUAL-PASS COOLING COILS

RELATED APPLICATIONS

This application is a continuation-in-part of application Ser. No. 13/317,660, filed Oct. 25, 2011 and claims priority in part under 35 U.S.C. §120 therefrom, which application is incorporated by reference therefrom.

FIELD OF THE INVENTION

The present invention relates to drip pans for substantially horizontally oriented dehumidification cooling coils.

BACKGROUND OF THE INVENTION

The purpose of a cooling coil drain pan is to capture condensed water from a cooling coil, and route it to a drain, without leaving areas of stagnant water behind Drain pans are a potential source of microbial contamination. Until recently, most air handlers and terminal units with cooling coils were designed with flat drain pans. However, ASHRAE Standard 62 now stipulates regarding drain pans that pans intended to collect and drain liquid water shall be sloped at least 0.125 inches per foot or shall be otherwise designed to ensure that water drains freely from the pan whether the fan is on or off.

Vertically positioned cooling coils are mounted in a vertical or near vertical position. Horizontally positioned cooling coils are mounted in a horizontal, or near horizontal position. In both cases, condensate flows downward with gravity, into the drain pan.

The prior art reveals applications of permanently installable horizontally positioned dual pass cooling coils. In U.S. Pat. No. 5,816,315 of Stark, horizontally extending cooling coils are used with plate-type cross flow air-to-air heat exchangers in a dehumidification application. In U.S. Pat. No. 5,913,360 of Stark, horizontally extending cooling coils are used in conjunction with air flow dampers in another dehumidification application.

The prior art also discloses vertical or near vertical positioned cooling coils with narrow drain pans. For example, U.S. Pat. No. 4,135,370 of Hosoda describes a dehumidification system with a vertically oriented evaporator 4 with a single drip pan 7 below the evaporator 4. U.S. Pat. No. 6,203,036 of LaVaute describes a Busing Cart with separate drip pans in general for transporting non-analogous dishes. U.S. Pat. No. 6,484,512 of Anderson describes temperature controlled drawers that use a plurality of drip pans, such as disclosed in two separate non-integral drip pans 89 and 148 below a vertically oriented heat sink 124 in FIG. 5.

Unlike vertical or near vertical positioned cooling coils, such as in Hosada '370, that require relatively narrow drain pans, horizontal, or near horizontal positioned, cooling coils, such as cooling coils 66 of Stark '315 and Stark '360, have a larger drip surface area and therefore require larger drain pans for collecting condensed moisture and routing it to drainage connection(s).

Problems with single large drain pans under horizontally extended cooling coils are that they exceed the width of traditional construction materials and therefore require seams in the drain pan floor to join pieces together. This joining results in potential for leaks, added assembly labor, uneven and non-uniform pan surfaces which thereby increases the required slope to ensure full drainage with no areas of stagnant water.

a. Seams in the pan floor increase the possibility of leaks, increase cost of manufacturing and, in the case of stainless steel; heat from welding changes the properties of the metal at the weld joint, causing rust and accelerated deterioration. Welding long seams of a drain pan material is known to cause "buckling" which leads to pockets of trapped stagnant condensate. The remedy using single large drain pans is to increase the height dimension, to ensure complete drainage.
b. Increased slope means the pan height dimension must increase and consequently, the height of the entire apparatus must increase to ensure full drainage to the low point or drainage connection(s). Without proper slope, areas of stagnant water form on the surface of large pans. These areas of stagnant water are caused by a non-uniform surface that is a natural tendency over large surfaces. Thick material and/or stiffeners are needed to ensure a uniform flat and adequately sloped surface.
c. Therefore, there is a need to provide efficient drainage of water underneath horizontally extending cooling coils.

OBJECTS OF THE INVENTION

It is therefore an object of the present invention to provide efficient drainage of water underneath horizontally extended cooling coils.

It is also an object of the present invention to provide horizontal cooling coils having large horizontal drip surfaces with multiple drain pans.

It is yet another object of the present invention to create a drain pan, made of a single piece of material, with no floor seams and no stagnant water.

It is also an object of the present invention to provide a plurality of adjacent horizontal cooling coils, acting together as a module, each with at least one drain pan.

It is a further object of the present invention to provide insertable and removable horizontal cooling coils which can be replaced or maintained efficiently.

Other objects which become apparent from the following description of the present invention.

SUMMARY OF THE INVENTION

The concerns raised in the prior art relating to large horizontal drip surfaces are best served with multiple drain pans as in the solution offered by this invention.

In keeping with the Objects of the Invention, it is the intent of this invention to use sloped drain pans, made of a single piece of material, with no floor seams and therefore resulting in no stagnant water for the purpose of capturing and routing condensate to drain connections.

Modular drain pans, with multiple drain connections, mounted under one or more horizontal cooling coils, offer greater slope with less height, minimal stagnant water, minimal height and no base seams.

In one embodiment of this invention, the entire drip surface area of one or more horizontally oriented cooling coils is serviced by two or more drain pans intercepting all drips. The size of each sloping pan is such that it is fabricated of a single sheet of material of commonly available size. This obviates the need for sheet joining and also reduces the pan height as compared to a larger single pan of comparable floor slope.

To prevent leakage between multiple drain pans, an optional drip umbrella or cap with an upside-down "V" cross section bridging the top edges of adjacent pans is used divert any impinging drips into one or the other pan. Where the horizontally positioned cooling coil is actually a plurality of adjacent horizontally oriented coil coils, each horizontally oriented cooling coil can have one or more integrally formed drain pans underneath. If a single drain pan is used under a separate horizontally positioned cooling coil, then the drip umbrellas are not needed, as there are no adjoining drain pans. If, however, one or more integrally formed drain pans are positioned under each separate horizontally positioned cooling coil, then preferably drip umbrellas or caps need to be provided between adjacent drain pans.

In an alternate embodiment, a module can be formed of a plurality of adjacent, side by side, cooling coils in a module, each cooling coil with one or more drain pans underneath.

In another embodiment each of the one or more horizontally mounted cooling coils is inserted from the end of the housing and sealed with flap or bulb gasket seals to the heat exchanger section above. This facilitates ease of initial assembly or service change-out. The gasket seals are selected of materials designed to last the life of the equipment. New gaskets are to be provided to insure sealing integrity in case of re-insertion.

Note that for dual-pass dehumidification applications of this general equipment, a variety of heat exchanger types can be used atop the cooling coils. Specifically, either the plate type heat exchanger described in U.S. Pat. No. 5,816,315 or the heat pipe heat exchanger of Applicant's patent application Ser. No. 13/317,660 can be used, wherein elongated, smaller-diameter tube heat pipes have an airflow arrangement that allows for short distances between evaporating and condensing sections of the heat pipe. The heat pipe is exposed to multiple alternate hot and cold zones adjacent to each other. Each evaporator zone accepts input heat to cause evaporation of the working fluid in the wick of the immediate vicinity. The vapor produced moves to either side by local pressure differences to condense in the two adjacent condenser zones where it is absorbed by the wick as a liquid and flows in the wick back to adjacent evaporator zones at each side. Each evaporator zone creates two fluid loops whereby evaporated working fluid splits up left and right, condenses in adjacent condenser zones and flows back to the evaporator zone as a liquid within the wick. Therefore, the overall tube length can be increased indefinitely, without traditional degradation of performance.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

Figure 1:
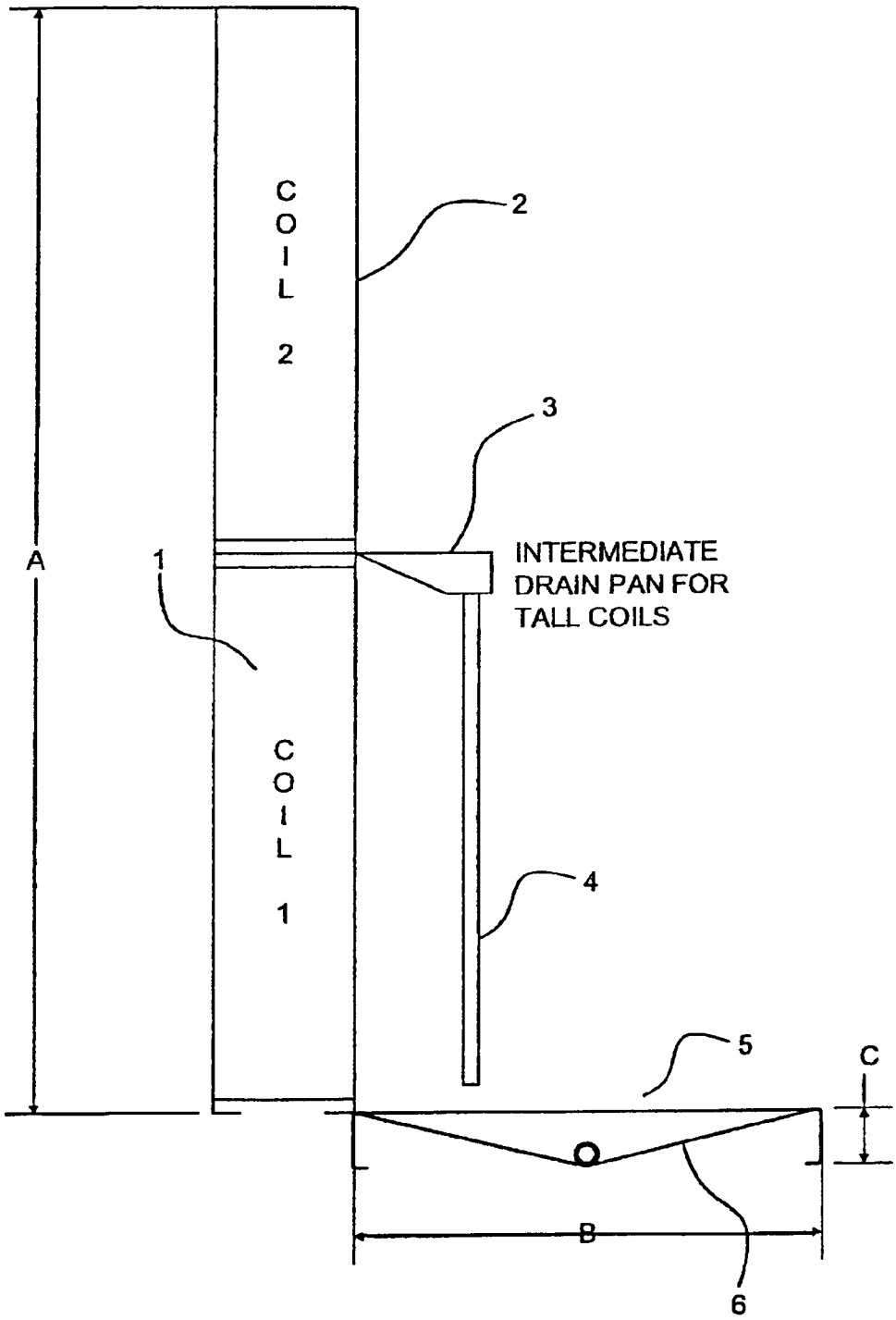
Fig. 1 (Prior Art)
FIG. 1 is an end schematic view of a tall Prior Art vertical cooling coil with a sloped drain pan.

FIG. 1 shows a prior art tall vertical cooling coil partitioned into a bottom coil 1 with a coil 2 atop. For very tall coils such as this, an intermediate drain pan 3 can be used with a conduit 4 to a main drain pan 5 at the bottom. Note that although the height "A" may be great, the drip surface is modest for this vertically oriented situation and can be serviced by drain pan 5 of modest dimensions (width "B" and height "C") and sloping bottom 6.

Figure 2:
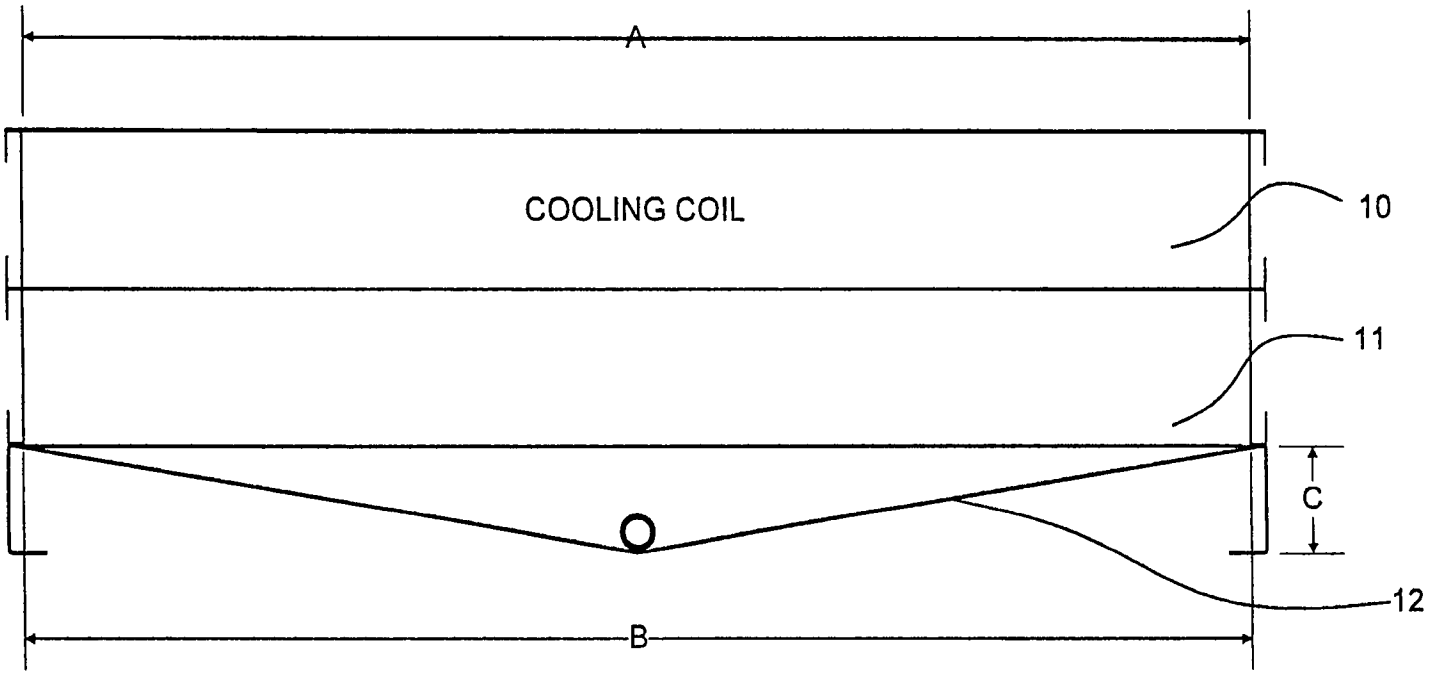
Fig. 2 (Prior Art)
FIG. 2 is an end schematic view of a Prior Art single sloped drain pan under a horizontally positioned dual pass cooling coil.

FIG. 2 shows a prior art horizontal cooling coil 10 being serviced by a drain pan 11 beneath with a sloping bottom of equivalent bottom slope 12 to that of slope 6 shown in FIG. 1. The large size of the required single pan 11 is of equivalent area to the drip area of horizontal cooling coil 10. It is noted that the length "A" of cooling coil 10 (laid horizontally) must equal the width "B" of pan 11. Height dimension "C" of pan 11 is also greater than that of pan 5 in FIG. 1 to maintain the equivalent slope 12. It is also noted that a pan the size of drain pan 11 typically requires welded seams since sheet metal is not typically available in the required size for one-piece construction.

Figure 3:
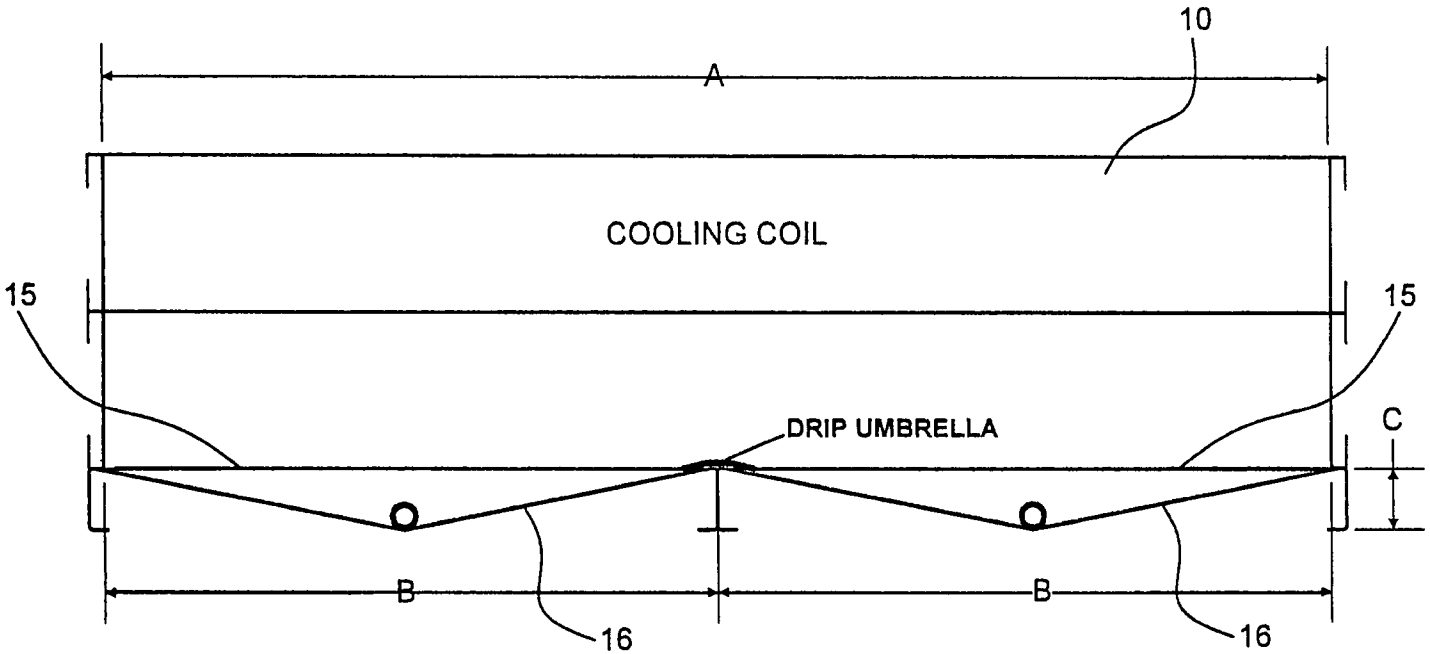
Fig. 3 (Prior Art)
FIG. 3 is an end schematic view of multiple sloped drain pans of this invention under a horizontally positioned dual-pass cooling coil.

FIG. 3 shows the multiple drain pan solution of this invention. Instead of a single pan 11 under cooling coil 10 as in Prior Art drawing FIG. 2, two or more drain pans 15 are used adjacent to each other. Each drain pan 15 has a width "B" which is only one half the width of drain pan 11. Having a slope 16 equivalent to that of pan 11 of FIG. 2, the height is also reduced to dimension "C" of FIG. 3. A drip umbrella or cap 17 bridges the top edge of each of the two adjacent drain pans 15 to prevent drip leakage from coil 10 above. Drain pans need not be split 50%-50%. Any combination resulting in 100% of the width is acceptable.

Two or more drain pans 11 of even smaller dimensions can be used. With this flexibility, it is feasible to use non-metallic sloped drain pans which can be molded or vacuum formed of plastic resins which avoid corrosion and reduce cost. Optionally, the sloped drain pans can be formed of a metal sheet bent to form each adjacent sloped drain pan module from a single piece of sheet metal.

Figure 4:
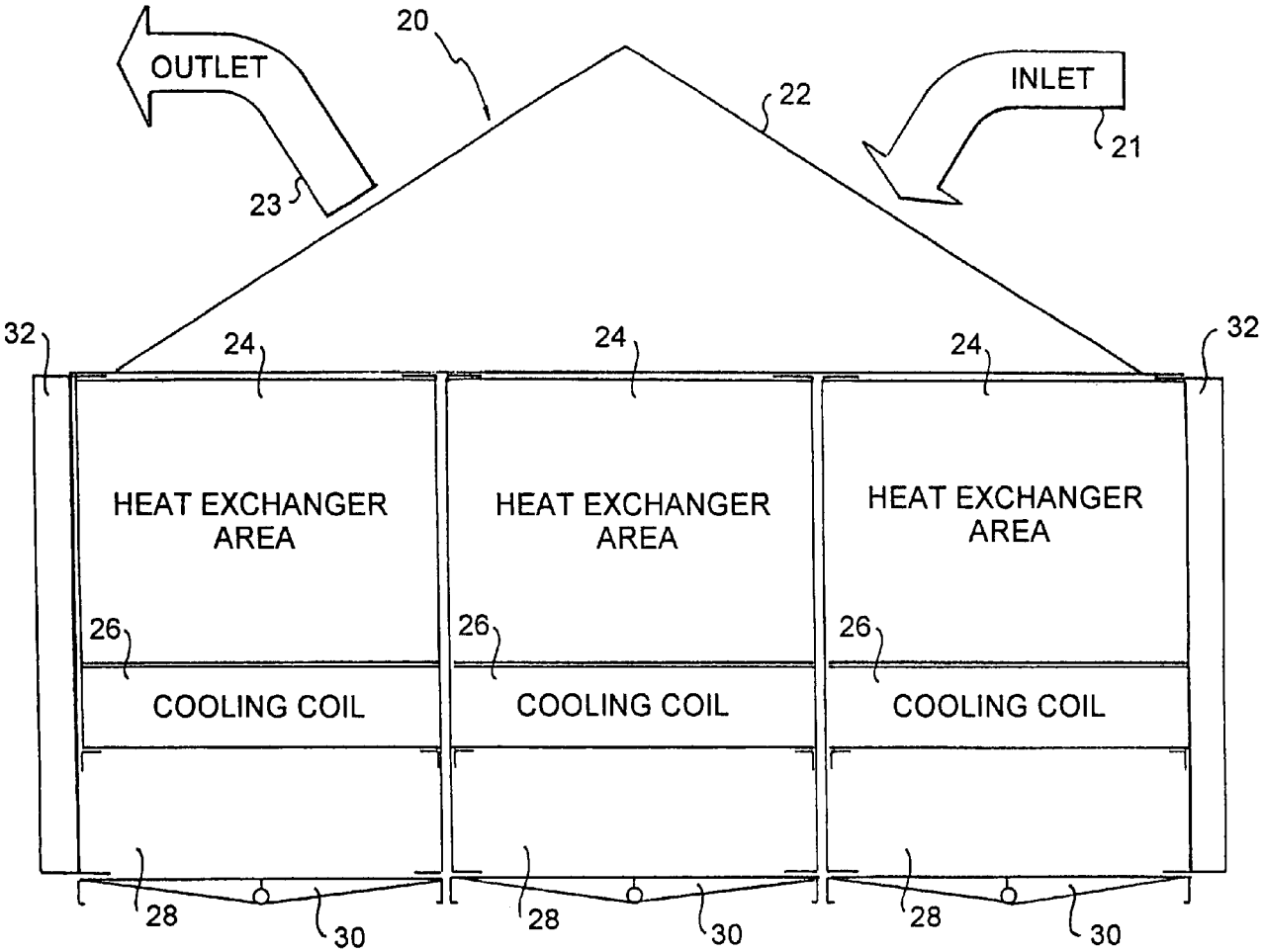
FIG. 4 is an end schematic view of an alternate embodiment where the horizontally positioned cooling coil is made of a plurality of adjacent discrete horizontally positioned cooling coils.

FIG. 4 shows an alternate embodiment for a module assembly system 20 formed using units of multiple discrete horizontal cooling coil modules, placed side by side, thereby creating one large horizontally positioned cooling coil assembly with multiple discrete drain pans 30 and multiple discrete cooling coils 26. Since each module preferably has its own drain pan, no drip umbrellas or caps are needed, unless each module requires two or more drain pains beneath a respective module. The module assembly system 20 comprises a single air distribution manifold 22 with inlet 21 at the right and outlet 23 at the left, heat exchange areas 24 below air distribution manifold 22 housing heat exchangers (shown in FIGS. 8 and 9), three separate adjacent discrete cooling coils 26, air reversal plenums 28 below each discrete cooling coil 26, with three separate discrete drain pans 30 below each respective discrete cooling coil 26, at a bottom of assembly system 20, and a pair of exterior positioned vertically extending opposite end plates 32 enclosing heat exchange areas 24, discrete cooling coils 26 and air reversal plenums 28 therebetween. This module assembly system 20 provides dual pass dehumidification.

Figure 6:
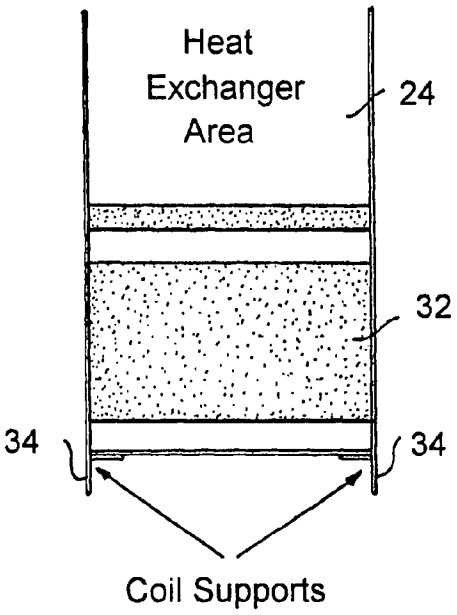
FIG. 6 is an end view of the insertable cooling coil of FIG. 5.
Figure 5:
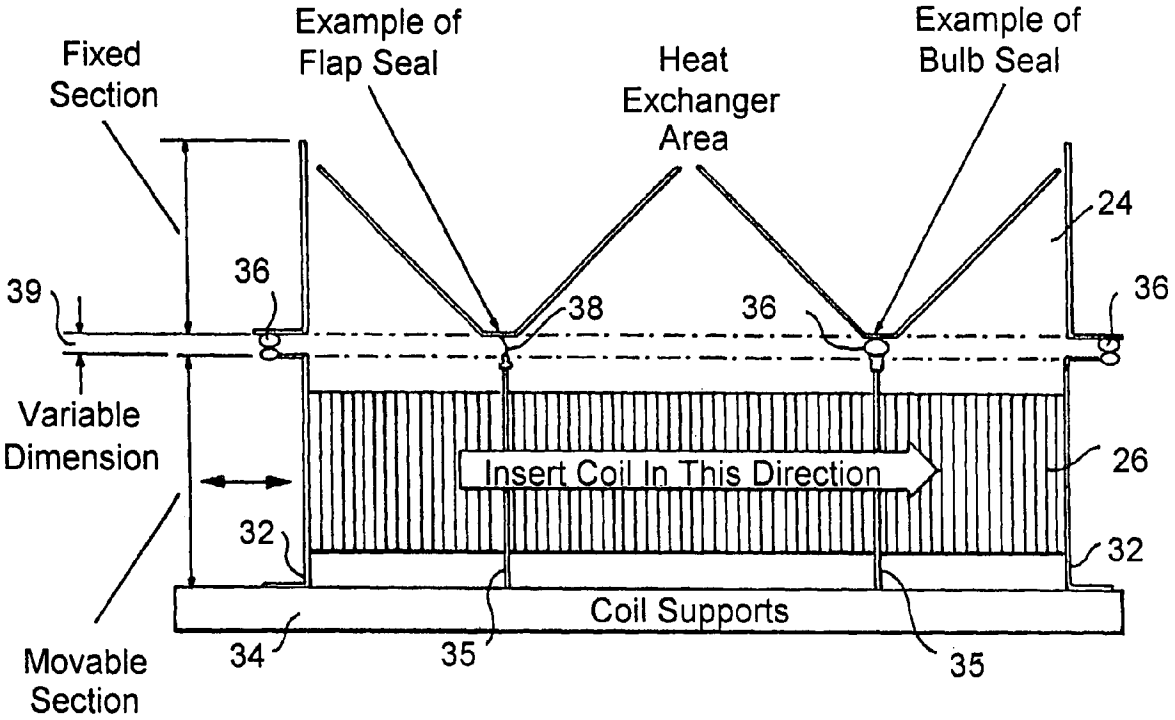
FIG. 5 is a side schematic view of an insertable horizontal cooling coil showing the use of flap or bulb seals to seal against the heat exchanger section above.

FIGS. 5 and 6 show a method using insertable cooling coils 26 such as used in the system of FIG. 4. However, a single cooling coil, such as in FIG. 2, can also be novel when insertable. These coils are inserted from one end of pre-assembled housing thereby facilitating ease of assembly even at the site whereby coils can be shipped separately. End plates 32 as well as internal baffles 35 are sealed to the heat exchangers 24 above by using either flap seals 38 or bulb seals 36, or both, each of elastomeric material. The sliding surface is comprised of side angle profile supports 34. Any repair or change-out requiring physical removal of a coil is thereby also facilitated without disassembly of the housing. This is most important in cases such as the central coil 26 shown in FIG. 4. Various types of mechanisms for sealing the coil are possible. For example, slide-in using a flap seals, or slide-in and raise, using bulb seals. FIG. 5 also shows the bulb seals 36 and flap seals 38 providing a sealed fit for the cooling coil 26 in the variable dimension region 39 between the top of cooling coil 26 and the bottom of the respective heat exchange area 24 above the cooling coil 26. While FIG. 5 shows the bulb seal 36 and the flap seal 38 having the same height as the height of the variable dimension region 39, it is known that in an alternate embodiment (not shown) the variable dimension region 39 can have a height taller than the height of each respective bulb seal 36 or flap seal 38, so that when the cooling coil 26 is inserted above coil support 34, the cooling coil is optionally raised by the coil support 34 to provide a tight fit for the bulb seal 36 or flap seal 38 between the top of the cooling coil 26 and the bottom of the heat exchange area 24. While FIGS. 2-10 refer to horizontally positioned cooling coils 10, 26 or 42, it is known that a vertically positioned coiling coil, such as shown in prior art drawing FIG. 1, can also be insertable and therefore novel, when combined with the insertion elements including end plates and internal baffles sealed to respective heat exchangers by using either flap seals, 38, bulb seals 36, or both, as well as a sliding surface similar to side angle profile supports 34.

Figure 7:
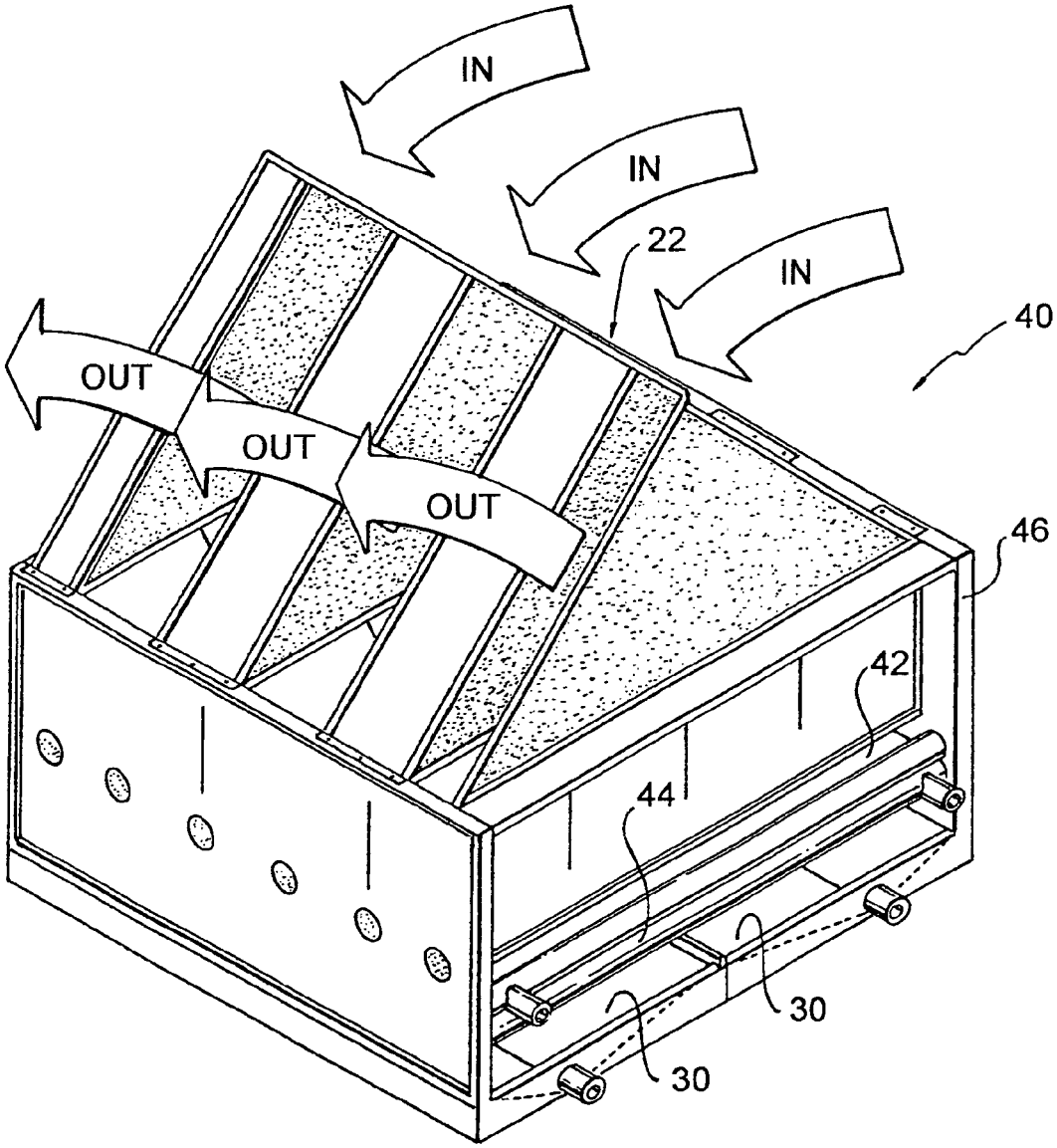
FIG. 7 is a perspective view of a dual pass dehumidification system with a single horizontal coil with two adjacent drain pans and a single distribution manifold atop the heat exchanger section.
Figure 8:
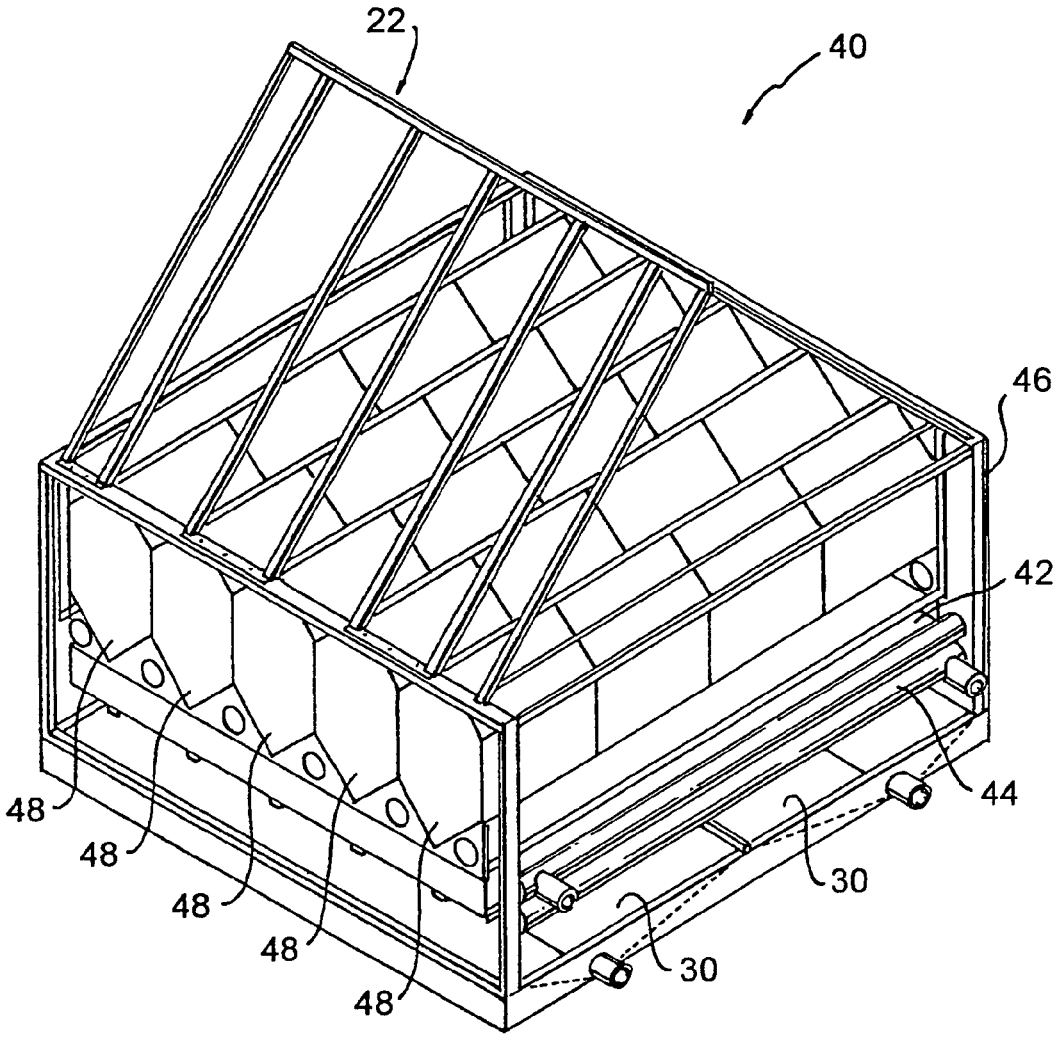
FIG. 8 is a perspective detail of the interior of the system of FIG. 7 showing the use of plate type heat exchangers.

FIGS. 7 and 8 show details of a dual pass dehumidification system 40 incorporating a single horizontal cooling coil 42 with optional coolant manifold 44. The internal channels of distribution manifold 22 at the top are shown. Dual adjacent drip pans 30 are shown at the bottom. FIG. 8 shows a cutaway of FIG. 7 and the use of plate type heat exchangers 48 within heat exchanger housing region 46. Although FIGS. 7 and 8 show single horizontal cooling coil 42, it is known to those skilled in the art of heat exchangers and dehumidification that optionally a plurality of cooling coils can be used, such as, for example, the plurality of cooling coils 26 shown in FIG. 4, or multiples of single cooling coil 10 in FIGS. 2 and 3, whether permanently installed or insertably removable as shown in FIGS. 5 and 6.

Figure 9:
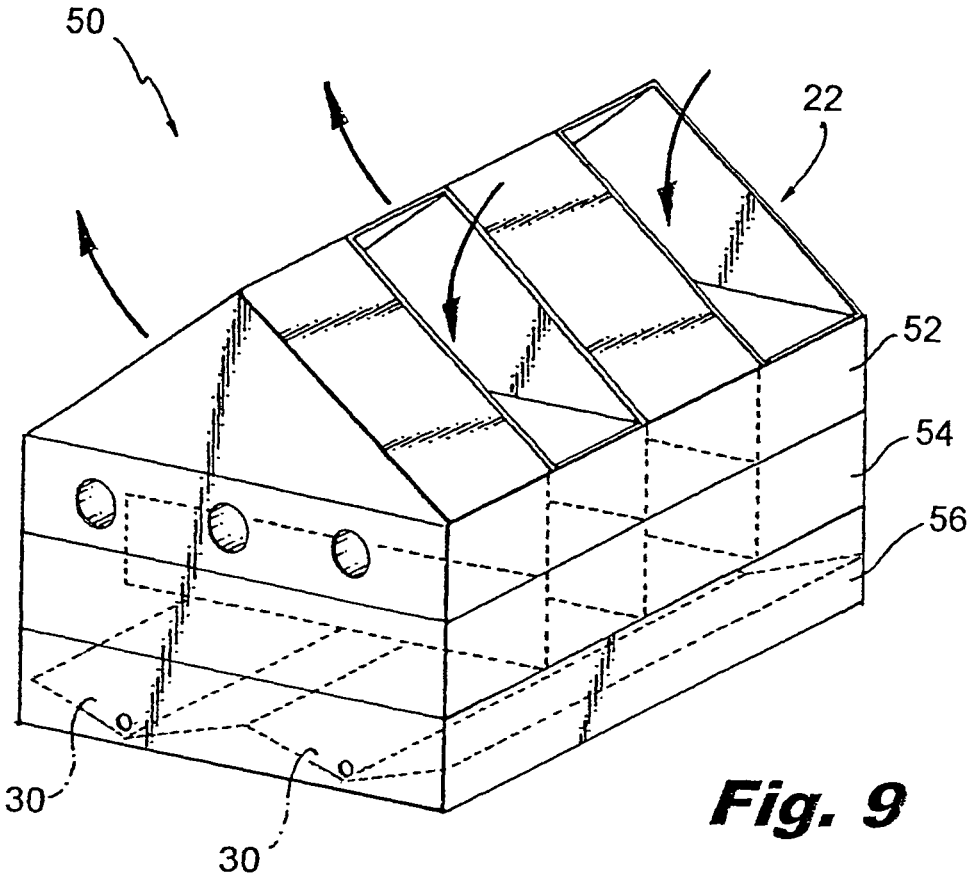
FIG. 9 is a perspective view of a system incorporating one or more adjacent cooling coils, a single distribution air manifold atop a heat pipe heat exchanger, and two adjacent drain pans at the bottom of the air flow reversal plenum.

FIG. 9 shows system 50 similar to that of FIG. 7 but using a heat pipe heat exchanger 52 in place of plate type heat exchangers 48. Housing section 54 contains one or more horizontal finned cooling coils, such as cooling coils 10, 26 or 42. Two adjacent drain pans 30 (in phantom lines) are located at the bottom of flow reversal plenum 56.

Figure 10:
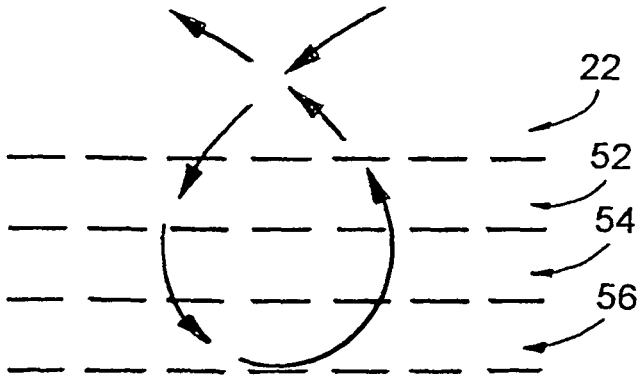
FIG. 10 is a schematic flow diagram illustrating air flow from inlet at manifold, through a heat exchanger, then through the cooling coil or coils, reversing inside the plenum below and then up through a second pass through the cooling coil or coils, through the heat exchanger and then through the manifold outlet.

FIG. 10 illustrates the air flow path of the full circuit of the dual pass dehumidification cycle from manifold 22 and back out.

FIGS. 9 and 10 are based upon FIGS. 10 and 11 of Applicant's co-pending application Ser. No. 13/317,660, wherein the dehumidification system of FIG. 10 therein uses a single triangular manifold atop a heat pipe heat exchanger (HPHE) with a rectangular cooling coil underneath and a drip pan at the bottom. The cooling coil identified in application Ser. No. 13/317,660 has internal baffles in registration with manifold partitions above to continue the separation of flow regions. With these internal baffles, the two-pass air flow through the dehumidifier is achieved.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. An insertable, removable dual pass cooling coil in a heat exchange unit comprising:

a heat exchange housing;

at least one cooling coil in a heat exchange assembly in said housing;

said housing being a pre-assembled housing having at least one recess for insertion or removal of said at least one cooling coil therein for replacement, repair or maintenance thereof, wherein each said at least one cooling coil is slidably and removably insertable upon supports within said recess of said pre-assembled housing;

said at least one cooling coil being retained by a plurality of baffles and opposite end plates accommodating said at least one slidably and removably insertable cooling coil therein; wherein further said end plates and said baffles each having at least one elastomeric seal sealing said end plates and said baffles to an interior surface of said recess of said pre-assembled housing accommodating said at least one insertable cooling coil therein, whereby said insertable at least one cooling coil is slidably removable from said recess of said pre-assembled housing for repair or maintenance thereof;

wherein said at least one elastomeric seal is a plurality of seals providing a sealed fit for said at least one cooling coil in a variable dimension region between a top of said at least one cooling coil and a bottom of a respective heat exchange area above said at least one cooling coil.

2. The insertable, removable dual pass cooling coil in a heat exchange unit as in claim 1 wherein each said variable dimension region has a height taller than a height of each respective seal, wherein when said at least one cooling coil is inserted above a respective coil support, said respective at least one cooling coil is raised by said respective coil support to provide a tight fit for said respective seal between said top of said respective at least one cooling coil and said bottom of said respective heat exchange area.

3. The insertable, removable dual pass cooling coil in a heat exchange unit as in claim 1 wherein said at least one cooling coil is a plurality of cooling coils.

4. The insertable, removable dual pass cooling coil in a heat exchange unit as in claim 2 wherein said at least one cooling coil is a plurality of cooling coils.

5. The insertable, removable dual pass cooling coil in a heat exchange unit as in claim 1 wherein said at least one cooling coil is a horizontally positioned cooling coil.

6. The insertable, removable dual pass cooling coil in a heat exchange unit as in claim 1 wherein said at least one cooling coil is a vertically positioned cooling coil.

7. The insertable, removable dual pass cooling coil in a heat exchange unit as in claim 1 wherein said supports are side angle profile supports.

* * * * *